United States Patent [19]

Itoh et al.

[11] Patent Number: 4,605,142

[45] Date of Patent: Aug. 12, 1986

[54] SYNTHETIC RESIN VESSEL AND HEAT SEALED LID

[75] Inventors: Shoji Itoh, Yokohama; Yukio Yanagawa; Kouzō Wakabayashi, both of Saitama, all of, Japan

[73] Assignees: Toyo Seikan Kaisha, Ltd.; Tokan Kogyo Co., Ltd., both of Tokyo-To, Japan

[21] Appl. No.: 631,637

[22] Filed: Jul. 17, 1984

[51] Int. Cl.[4] ..... B65D 41/00

[52] U.S. Cl. ..... 220/359; 220/260; 229/43

[58] Field of Search ..... 220/359, 260; 229/43; 206/631, 632

[56] References Cited

U.S. PATENT DOCUMENTS 4,044,941 8/1977 Knudsen ..... 220/359
4,207,989 6/1980 Ingemann ..... 229/43
4,215,797 8/1980 Chen ..... 229/43

*Primary Examiner*—George T. Hall
*Attorney, Agent, or Firm*—Robert E. Burns; Emmanuel J. Lobato; Bruce L. Adams

[57] ABSTRACT

A synthetic resin vessel composed of a sheet of a synthetic resin and having a top opening, wherein: a flange is formed integrally with and along the edge portion of the opening; a continuous ridge protuberance is formed on and along the top face of the flange; and a lid is heat-sealed through the protuberance to close the opening and is subsequently openable by a seal-opening operation, the synthetic resin vessel being characterized in that a projection extending toward the outer periphery is formed in one or both of portions of the protuberance for starting and terminating the seal-opening operation. This synthetic resin vessel has a high sealing property and a good peelability.

19 Claims, 10 Drawing Figures

SYNTHETIC RESIN VESSEL AND HEAT SEALED LID

BACKGROUND OF THE INVENTION

1. Field of the Invention

The present invention relates to a synthetic resin vessel. More specifically, the present invention relates to a synthetic resin vessel composed of a sheet of a synthetic resin and having a top opening, wherein a protuberance of the form of a corrugation ridge is formed on the top face of a flange formed integrally with and along the edge portion of the opening, and a lid is heat-sealed through this protuberance to close the opening.

2. Description of the Prior Art

Vessels fabricated by vacuum forming or compressed air forming of a synthetic resin sheet, for example, cup-shaped vessels, are used for packaging and selling various foods and the like because the manufacturing cost is low. When such a vessel is to be circulated in the market after packaging of the content, it is necessary to close the opening by some means. According to the conventional method, a flange is formed integrally with the peripheral edge portion of the opening of the synthetic resin vessel; a lid composed of a synthetic resin film or a laminate of a synthetic resin film and an aluminum foil is placed on the flange; and the lid is heat-sealed to the edge portion of the opening of the vessel through the flange to close the opening.

According to this sealing method, especially when a vessel is fabricated by vacuum forming or compressed air forming, the thickness of the flange is likely to become uneven and the surface evenness is not sufficiently high. Accordingly, even if a lid is bonded to this flange by heat sealing, insufficient adhesion of the lid is readily caused, resulting in leakage of a liquid content. Furthermore, according to this sealing method, when the vessel content or a water drop adheres to the surface of the flange, insufficient bonding is caused also for this reason. Moreover, since a lid having a conventional seal structure is fused to the vessel through substantially the entire surface of the flange, a large force is necessary for opening the vessel by peeling off the lid. This is another problem of the conventional method.

As means for overcoming these difficulties, a part of the present inventors previously proposed in Japanese Utility Model Application Laid-Open No. 35376/1984 a synthetic resin vessel in which heat sealing can be positively accomplished, and the sealed lid can be easily peeled off. In this synthetic resin vessel, a continuous protuberance in the form of a corrugation ridge is formed along the peripheral part of a flange for bonding of a lid, and bonding is accomplished between the top ridge of the protuberance and the lid by heat sealing. However, even if this method is adopted, since positive sealing of the vessel and easy peeling off of the lid are contradictory to each other, it is very difficult to completely satisfy both of the requirements simultaneously.

Moreover, a vessel having a conventional structure in which a lid is heat-sealed through a protuberance formed on a flange to close an opening, especially one fabricated by vacuum forming or compressed air forming, is disadvantageous in that the seal strength is rendered uneven by the thickness unevenness in the sealed portion of the vessel. Still further, since the protuberance for sealing is formed along the edge portion of the opening, a large force is necessary at the beginning and end of the peeling operation, and the force required for opening the vessel varies greatly. Therefore, the content is often spilled during the opening operation. In addition, if it is intended to increase the sealability of the vessel, the peel strength is further increased, and the peeling operation becomes difficult. Still another problem is that, since a force must be applied in the peeling operation, the vessel is required to have a holding strength sufficient to resist this force. Accordingly, in this conventional vessel, the thickness of the vessel proper must be increased beyond a certain value, and increase of the manufacturing cost cannot be avoided.

SUMMARY OF THE INVENTION

It is therefore an object of the present invention to provide a synthetic resin vessel in which the above described problems of the conventional vessels are overcome; a good sealing property is attained; and the lid can be peeled off very easily.

Another object of the present invention is to provide a synthetic resin vessel in which the peeling force can be reduced at either the beginning or end of the peeling off of the lid, or both, while preventing the content of the vessel from dropping or spilling out.

Still another object of the present invention is to provide a synthetic resin vessel in which a large holding strength is not necessary for the vessel proper.

In accordance with the present invention, these objects can be attained by a synthetic resin vessel composed of a synthetic resin and having a top opening wherein a flange is formed integrally with the edge portion of the opening; a continuous protuberance is formed as a corrugation ridge on the top face of the flange; and a lid is to be heat-sealed through the protuberance to close the opening and is subsequently to be removed by unsealing, the synthetic resin vessel being characterized in that a projection extended toward the outer periphery is formed in the portion of the protuberance where an operation for the unsealing is started or/and terminated.

In the vessel of the present invention, a projection extended toward the outer periphery is formed in the portion of the protuberance where the unsealing operation is to be started or terminated. By this characteristic feature, the peeling force can be reduced at the beginning or end of the unsealing operation and variation of the peeling force can be diminished. Accordingly, an easily openable synthetic resin vessel having a high sealing property can be provided according to the present invention.

Figure 1:
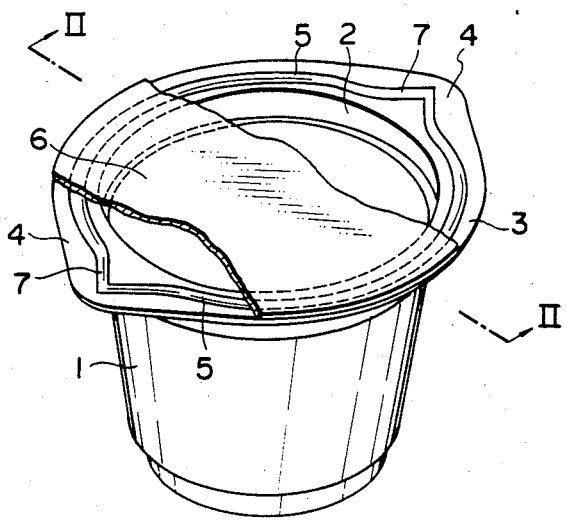
FIG. 1 is a perspective view illustrating a synthetic resin vessel according to one embodiment of the present invention.

In the drawings, reference numerals 1, 2, 3, 4, 5, 6, 7 and 8 represent a synthetic resin vessel proper, an opening, a flange, a projection, a protuberance, a lid, a beak-like projection and an inclined face, respectively.

DETAILED DESCRIPTION OF THE PREFERRED EMBODIMENTS

The present invention will now be described in detail with reference to embodiments thereof illustrated in the accompanying drawings.

Figure 2:
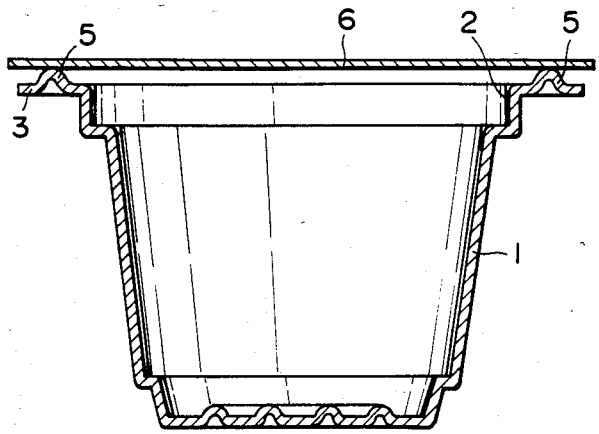
FIG. 2 is a section taken along the line II—II in FIG. 1.
Figure 3:
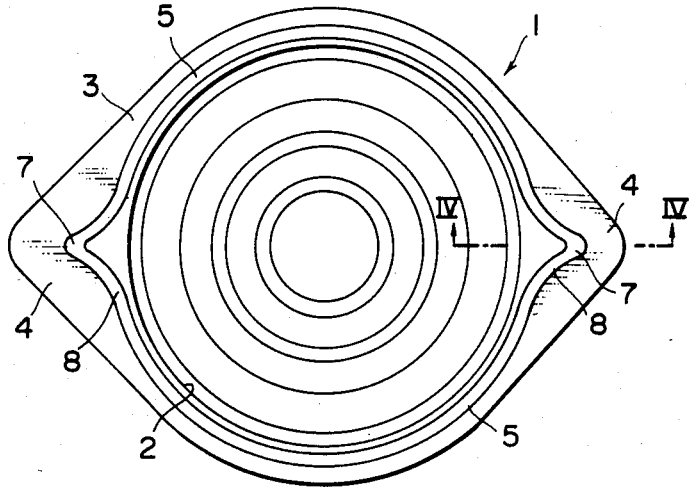
FIG. 3 is a plan view showing the vessel proper.

FIGS. 1 through 3 show a synthetic resin vessel proper or body 1 according to one embodiment of the present invention. This vessel proper 1 is fabricated by, for example, vacuum forming of a synthetic resin sheet and has a cup-like shape. The vessel proper 1 may be shaped by compressed air forming or injection molding instead of vacuum forming. An opening 2 is formed on the top portion of the vessel proper or body 1, and a flange 3 is formed integrally with the peripheral edge portion of the opening 2. A pair of extensions 4 symmetric with respect to the center of the vessel proper 1 are formed on the flange 3, and an annular protuberance 5 is formed to protrude upward on the top face of the flange 3 provided with the pair of extensions 4. As shown in FIGS. 1 and 2, a lid 6 is sealed to the vessel proper 1 by heat fusion bonding through this annular protuberance 5 to cover the opening 2. That is, the lid 6 is bonded to the peripheral portion of the opening of the vessel proper 1 on the top face of the protuberance 5 which defines a continuous sealing surface for the lid.

The structure of the annular protuberance 5 will now be described in detail.

Figure 4:
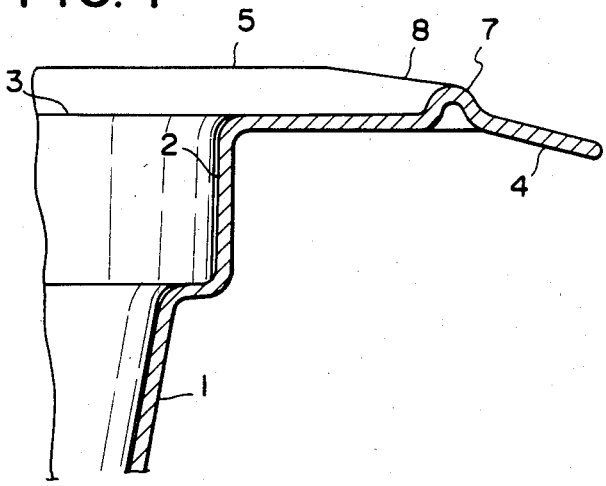
FIG. 4 is an enlarged fragmentary section taken along the line IV—IV in FIG. 3.

As shown in FIGS. 3 and 4, the protuberance 5 formed on the top face of the flange 3 has a radially pointed portion in the shape of a beak-like projection 7 extending radially outward toward the outer periphery of each extension 4, and the tip of the projection 7 is directed toward the tip of the extension 4. Since a pair of such beak-like projections 7 are formed on the extensions 4, respectively, the projections 7 constitute portions where the unsealing or peeling operation is started and terminated, respectively. Therefore, peeling off of the lid 6 can be remarkably facilitated at the beginning and end of the peeling operation. Moreover, since the beak-like projection 7 has on the top face thereof an inclined face 8 such that its height is gradually reduced toward the tip of the beak-like projection 7, the force for peeling the lid 6 is reduced on the top end side of the beak-like projection 7. Moreover, since the top end side of the extension 4 is bent obliquely downward, the top end of the extension 4 can be gripped by the fingers when the lid 6 is peeled off.

As will be apparent from the foregoing description, the opening 2 formed on the top portion of the vessel proper 1 of the present embodiment is closed by the lid 6, and the lid 6 is heat-sealed to the top face of the protuberance 5 of the flange 3 formed in the peripheral portion of the opening 2. As shown in FIGS. 3 and 4, the protuberance 5 has a beak-like projection 7, by which the peeling force at the beginning and end of the peeling operation can be reduced, and variation of the peeling force during the peeling operation can be diminished by the presence of the projection 7.

Figure 5:
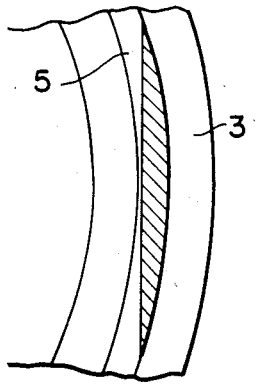
FIGS. 5 through 7 are enlarged fragmentary plan views showing the essential parts of vessels for a description of differences in the peeling force necessary for opening vessels.
Figure 6:
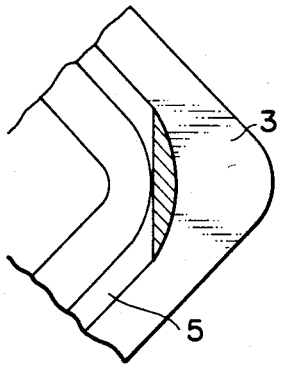

The reason why this functional effect is attained in the present invention will now be described with reference to FIGS. 5 through 7. In a popular conventional vessel, a relatively broad area shown hatched in FIG. 5 of the protuberance 5 must be opened, whereby a great opening force is necessary, and variation of the peeling force at the beginning of the peeling operation becomes great. In contrast, when the portion where peeling is started is formed at the corner of a rectangular vessel as shown in FIG. 6, the opening area shown hatched in FIG. 6 of the protuberance 5 is reduced, and the peeling force for opening the vessel is less than that in the vessel shown in FIG. 5. However, a considerably great force is still necessary and variation of the peeling force is still considerable.

Figure 7:
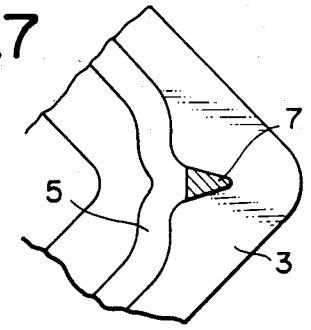

On the other hand, as shown in FIG. 7, in the vessel proper 1 of the present example of the invention, the opening area shown hatched in FIG. 7 of the beak-like projection 7, where opening of the vessel is started, is greatly reduced and a very small force is sufficient for starting the peeling, and variation of the peeling force can be remarkably diminished, whereby opening of the lid 6 can be started very smoothly. Moreover, in the vessel proper 1 of the present embodiment of the invention, since the above described beak-like projection 7 is formed on each of the two extensions 4 of the flange 3, both the peeling force necessary for starting the opening and the peeling force at the termination of the peeling can be diminished and variation of the peeling force can be reduced.

In the vessel proper 1 of the present embodiment, since the beak-like projection 7 is formed on the extensions 4, the bonding force can be gradually reduced toward the tip of the beak-like projection 7. When the beak-like projection 7 is formed on the extension 4, the thickness of the beak-like projection 7 tends to increase because of the drawing force generated during vacuum forming or compressed air forming, whereby the peel strength is unnecessarily increased in this portion, and thickness unevenness is caused. As a consequence, the sealing becomes insufficient. By forming the inclined face 8 on the top face of the beak-like projection 7, the thickness of this portion is reduced and the thickness unevenness is diminished. Moreover, by the formation of this inclined face 8, the thickness can be reduced as compared with the thickness of other portions, and the peeling force or bonding force can be gradually diminished toward the tip of the beak-like projection 7. Therefore, according to the present example, the seal strength can be increased as a whole, and the peeling force can be reduced. In short, a vessel with an ideal easy-peelable lid having a good sealing property can be provided. Since such an easy peelability can be imparted to the vessel, spilling of the content can be prevented when the lid is peeled off. Therefore, the dead space in the vessel can be reduced This is another advantage attained by the present invention.

In the vessel proper 1 of the present example, since the outer end of the extension 4 of the flange 3 on which the beak-like projection 7 is formed is inclined downward as shown in FIG. 4, when the vessel is opened by peeling the lid 6, the extension 4 can be gripped by the fingers and it becomes unnecessary to press the barrel portion of the vessel proper 1. Accordingly, no holding strength need be given to the vessel proper 1, and the thickness of the vessel proper 1 can be reduced, or the thickness of a synthetic resin sheet to be subjected to vacuum forming or compressed air forming can be reduced. Moreover, since the outer top end portion of the extension 4 is bent or inclined downward, bonding of the lid 6 to the outer end portion of the extension 4 can be prevented.

Figure 8:
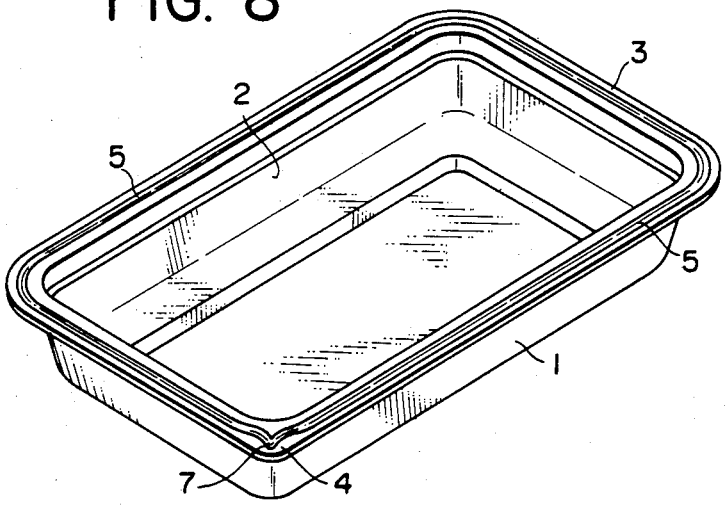
FIG. 8 is a perspective view showing a vessel according to one modification of the present invention.
Figure 9:
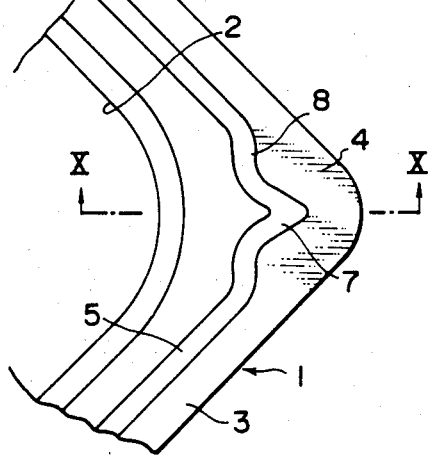
FIG. 9 is an enlarged fragmentary plan view showing an essential part of the vessel shown in FIG. 8.
Figure 10:
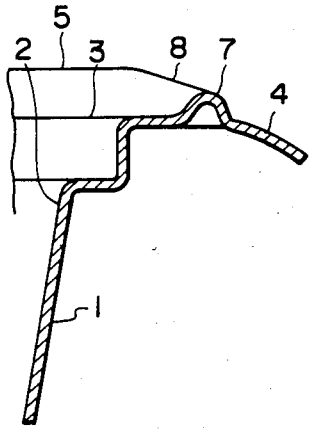
FIG. 10 is a section taken along the line X—X in FIG. 9.

A modification of the above-described embodiment of the invention will now be described with reference to FIGS. 8 through 10. In this modification, the present invention is applied to a rectangular saucer-like vessel. In this modification, portions and members corresponding to those of the preceding embodiment of the invention are designated by the same reference numerals, and detailed description of the structures of these portions and members is omitted. This modification is characterized in that the vessel proper 1 is formed to have a rectangular shape, and only one extension 4 is formed, whereby only one beak-like projection 7 is formed. More specifically, in the vessel proper 1 of this modification, an extension 4 provided with a beak-like projection 7 is formed in the portion of the lid 6 where opening is started. Accordingly, the peeling force at the start of opening is especially reduced and variation of the peeling force at the start of opening is diminished. Since the peeling force at the start of opening or unsealing is reduced, the entire seal strength can be increased, and a vessel having a high sealing property and a good easy peelability can be provided. Furthermore, since a large force is not necessary for peeling the lid 6, the amount of the content to be packed in the vessel proper 1 can be increased; the entire thickness of the vessel proper 1 can be reduced; and the range of sealing conditions can be much broadened. This is another advantage attained by the present invention.

The present invention has been described with reference to the embodiment and modification illustrated in the accompanying drawings. However, the scope of the present invention is by no means limited by these embodiment and modification, and various modifications can be made on the basis of the technical concept of the present invention. For example, the present invention can be applied to synthetic resin vessels having various shapes in addition to the cup-shaped vessel and rectangular saucer-like vessel illustrated in the embodiment of the invention and modification thereof described above. Moreover, the position of the beak-like projection 7 constituting the peeling-starting or peeling-terminating portion is not limited to the position shown in the above example or modification, it being possible for the beak-like projection 7 to be located at various other positions.

In the present invention, it is preferred that at least a heat-sealing surface of the flange 3 of the vessel proper 1, namely, the surface of the protuberance 5, be composed of a propylene resin. By the term "propylene resin" used herein is meant a resin composed mainly of propylene units. More specifically, examples of the propylene resin are polypropylenes, mixtures of polypropylene with other resins, and copolymers of propylene with monomers copolymerizable with propylene. As the material constituting the sealing surface of the vessel proper 1, an ethylene/propylene copolymer having an ethylene unit content of 5 to 40% by weight and a mixture of polyethylene and polypropylene are preferably used. If this resin is used in combination with a propylene resin constituting the sealing surface of the lid 6, described below, an appropriate seal strength can be obtained while an easily peelable state is maintained. An ethylene/propylene copolymer having an ethylene unit content of about 20% by weight is especially preferred.

The vessel proper 1 can be composed of a laminate material, so long as the sealing surface of the vessel proper 1 is preferably composed of a propylene resin, the materials for other layers being not critical. However, in order to readily prepare a cup having a shape shown in the drawings by deep drawing of a sheet or by injection molding, it is preferred that a single layer of a propylene resin as described above or a laminate having especially at least three layers and comprising a layer of a propylene resin and a layer of a thermoplastic resin such as an ethylene/vinyl alcohol copolymer or polyvinylidene chloride, which is thermoplastic as a whole, be used. It is especially preferred that at least one inner layer of the laminate be composed of an ethylene/vinyl alcohol copolymer.

It is preferred that the sealing surface of the lid 6 be composed of a propylene resin. Not only a single layer of a propylene resin but also a laminate of a propylene resin with a metal foil such as an aluminum foil or a sheet or film of a thermoplastic resin such as PET (polyethylene terephthalate) is preferably used for the lid 6. As the propylene resin constituting the sealing surface of the lid 6, an ethylene/propylene copolymer having an ethylene unit content of 5 to 50% by weight and a mixture of polypropylene and polyethylene are preferably used, and an ethylene/propylene copolymer having an ethylene unit content of about 30% by weight is especially preferred.

What is claimed is:

1. A vessel composed of a synthetic resin and having a top opening, a flange formed integrally with and along the peripheral edge portion of the opening, a continuous ridge protuberance formed on and along the top face of the flange, and a lid configured to overlie and rest upon the protuberance without contacting the interior of the vessel so that the lid can be heat-sealed through the protuberance to close the opening and can be removed by unsealing, said vessel having a projection of beak-like shape of the continuous ridge protuberance extending on the top face of the flange, the top face being substantially flat, toward the outer periphery at one or both portions of the protuberance where an operation for the unsealing is started or/and terminated.

2. A vessel composed of a synthetic resin and having a top opening, a flange formed integrally with and along the peripheral edge portion of the opening, a continuous ridge protuberance formed on and along the top face of the flange, and a lid to be heat-sealed through the protuberance to close the opening and to be removed by unsealing, said vessel having a projection extending toward the outer periphery at one or both portions of the protuberance where an operation for the unsealing is started or/and terminated, and wherein the outer end of the projection on the outer periphery side is inclined so that the height of the outer end is reduced.

3. A vessel composed of a synthetic resin and having a top opening, a flange formed integrally with and along the peripheral edge portion of the opening, a continuous ridge protuberance formed on and along the top face of the flange, and a lid to be heat-sealed through the protuberance to close the opening and to be removed by unsealing, said vessel having a projection extending toward the outer periphery at one or both portions of the protuberance where an operation for the unsealing is started or/and terminated, and wherein the projection is formed on an extension of the flange, and the tip of the extension is inclined downardly.

4. A synthetic resin vessel as set forth in claim 1, wherein the vessel is composed of a sheet having a laminate structure of at least three layers, of which at least one inner layer of the laminate structure is composed of an ethylene/vinyl alcohol copolymer.

5. A vessel for storing foodstuffs and the like comprising: a vessel body composed by synthetic resin and having a top opening, a flange having a substantially flat top face integral with and extending radially outwardly and continuously along the peripheral edge portion of the top opening, the flange extending radially outwardly at a constant angle relative to the sidewall of the vessel body around the entire periphery of the vessel body, an upwardly extending protuberance integral with and extending continuously along the top face of the flange to define a continuous sealing surface, the protuberance being radially spaced from the radial innermost and outermost extents of the flange and having a radially pointed portion, the flange having a radial outward extension on which extends the radially pointed portion, and the radially pointed portion having a generally V shape which is pointed in the radial outward direction; and a vessel lid dimensioned to overlie and rest upon the sealing surface of the flange protuberance without contacting the interior of the vessel body and being heat sealable therewith to seal closed the top opening.

6. A vessel for storing foodstuffs and the like comprising: a vessel body composed of synthetic resin and having a top opening, a flange having a substantially flat top face integral with and extending radially outwardly and continuously along the peripheral edge portion of the top opening, and an upwardly extending protuberance integral with and extending continuously along the top face of the flange to define a continuous sealing surface, the protuberance being radially spaced from the radial innermost and outermost extents of the flange and having a radially pointed portion, the radially pointed portion of the flange protuberance being pointed in the radial outward direction and tapering in height in the radial direction so that the radial outer end thereof is lesser in height than the radial inner end thereof; and a vessel lid dimensioned to overlie and rest upon the sealing surface of the flange protuberance and being heat sealable therewith to seal closed the top opening.

7. A vessel for storing foodstuffs and the like comprising: a vessel body composed of synthetic resin and having a top opening, a flange having a substantially flat top face integral with and extending radially outwardly and continuously along the peripheral edge portion of the top opening, and an upwardly extending protuberance integral with and extending continuously along the top face of the flange to define a continuous sealing surface, the protuberance being radially spaced from the radial innermost and outermost extents of the flange and having a radially pointed portion, the radially pointed portion of the flange protuberance being pointed in the radial outward direction, and the flange having a radial outward extension on which extends the radially pointed portion, the flange extension being inclined downwardly in the region radially outwardly of the flange protuberance; and a vessel lid dimensioned to overlie and rest upon the sealing surface of the flange protuberance and being heat sealable therewith to seal closed the top opening.

8. A vessel according to claim 5; wherein the flange protuberance has two radially pointed portions.

9. A vessel according to claim 8; wherein the two radially pointed portions are disposed in diametrically opposed relation about the top opening.

10. A vessel according to claim 8; wherein each radially pointed portion of the flange protuberance is pointed in the radial outward direction.

11. A vessel according to claim 10; whrein each radially pointed portion has a generally V shape.

12. A vessel according to claim 10; wherein the flange has two radially extending extensions on which extend respective ones of the radially pointed portions.

13. A vessel according to claim 6; wherein the flange protuberance has two radially pointed portions each being pointed in the radial outward direction and each tapering in height in the radial direction so that the radial outer end thereof is lesser in height than the radial inner end thereof.

14. A vessel according to claim 7; wherein the flange protuberance has two radially pointed portions each being pointed in the radial outward direction, and the flange has two radial outward extensions on which extend respective ones of the radially pointed portions, each flange extension being inclined downwardly in the region radially outwardly of the flange protuberance.

15. A vessel according to claim 5; wherein the constant angle is about 90°.

16. A synthetic vessel as set forth in claim 1, wherein the continuous ridge protuberance is configured to be ineffective as a pouring spout for pouring out the contents of the vessel.

17. A synthetic vessel as set forth in claim 1, wherein the sidewall of the vessel is free of any outwardly projecting portions in the region beneath the flange.

18. A vessel according to claim 5; wherein the flange protuberance is configured to be ineffective as a pouring spout for pouring out the contents of the vessel.

19. A vessel according to claim 5; wherein the sidewall of the vessel body is free of any outwardly projecting portions in the region beneath the flange.

* * * * *